US006623196B1

(12) United States Patent
Lee et al.

(10) Patent No.: US 6,623,196 B1
(45) Date of Patent: Sep. 23, 2003

(54) APPARATUS FOR REPLACING PHOTOSENSITIVE BELT, METHOD OF COMMUNICATING INFORMATION CONCERNING PHOTOSENSITIVE BELT, AND PRINTER EMPLOYING THE SAME

(75) Inventors: Beom-ro Lee, Suwon (KR); Kyu-sung Kim, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 134 days.

(21) Appl. No.: 09/676,816

(22) Filed: Oct. 2, 2000

(30) Foreign Application Priority Data

May 22, 2000 (KR) ..... 2000/27519

(51) Int. Cl.[7] ..... B41J 13/10

(52) U.S. Cl. ..... 400/629; 400/636.3; 399/116; 399/12

(58) Field of Search ..... 400/629, 624, 400/636.3, 636.2; 399/116, 162, 12, 13

(56) References Cited

U.S. PATENT DOCUMENTS 4,933,718 A * 6/1990 Furuya ..... 355/203
5,311,253 A * 5/1994 Ohmori et al. ..... 355/200
5,909,603 A * 6/1999 Suzuki et al. ..... 399/13
6,097,912 A * 8/2000 Watson et al. ..... 399/116
6,137,966 A * 10/2000 Uchara et al. ..... 399/13
6,236,823 B1 * 5/2001 Lee ..... 399/116

FOREIGN PATENT DOCUMENTS

| | | |
|---|---|---|
| JP | 04-328762 | 11/1992 |
| JP | 11-305632 | 11/1999 |
| JP | 11-338329 | 12/1999 |

* cited by examiner

*Primary Examiner*—Andrew H. Hirshfeld
*Assistant Examiner*—Anthony H. Nguyen
(74) *Attorney, Agent, or Firm*—Robert E. Bushnell, Esq.

(57) ABSTRACT

An apparatus for replacing a photosensitive belt of a printer, and a method of communicating belt-related information between a belt cartridge and the printer, are disclosed. The apparatus includes a belt cartridge adapted to receive a photosensitive belt so that the photosensitive belt can be installed at a belt unit of the printer, a first antenna installed on the belt cartridge, a second antenna installed on the printer and connected to a controller which controls the printer, and a component identifying module installed on the belt cartridge and connected to the first antenna so that the component-identifying module can transmit the information recorded therein to the second antenna connected to the controller the, and record information received from the controller via the second antenna.

10 Claims, 6 Drawing Sheets

APPARATUS FOR REPLACING PHOTOSENSITIVE BELT, METHOD OF COMMUNICATING INFORMATION CONCERNING PHOTOSENSITIVE BELT, AND PRINTER EMPLOYING THE SAME

CLAIM OF PRIORITY

This application makes reference to, incorporates the same herein, and claims all benefits accruing under 35 U.S.C. §119 from the inventor's application PHOTOSENSITIVE BELT EXCHANGE APPARATUS AND METHOD OF COMMUNICATING THEREOF AND PRINTER filed with the Korean Industrial Property Office on May 22, 2000 and there duly assigned Ser. No. 27519/2000.

BACKGROUND OF THE INVENTION

1. Field of the Invention

The present invention relates to an apparatus for replacing a photosensitive belt, a method of communicating information concerning a new photosensitive belt between a belt cartridge and a printer, and a printer employing the same. More particularly, the invention relates to an apparatus for replacing a photosensitive belt in which a printer utilizes information, recorded on new components to be installed, concerning the use of the component, a method of communicating information concerning a new photosensitive belt between a belt cartridge and a printer, and a printer employing the same.

2. Description of the Related Art

Conventional image formation equipment use a photosensitive belt in combination with a discharging device, a charger, laser scanning units, developing units, a drying unit, and a transfer unit. A belt unit is provided with a plurality of rollers that are positioned to circulate the photosensitive belt. The conditions of appropriate use of a photosensitive belt may vary however, by manufacturer and in accordance with changes in photosensitive belt technology. Such conditions may include, for example, a potential level that must be maintained at the photosensitive belt in order that an electrostatic latent image will be formed on the photosensitive belt, the intensity of light for illuminating the photosensitive belt in order that an electrostatic latent image may be formed on the photosensitive belt. Therefore, it is required that the operation conditions of individual units, for example, the discharging device, the charger, the laser scanning units, and the like be adjusted according to the use conditions of the installed photosensitive belt after the photosensitive belt is replaced in the image formation equipment. Conventionally, the operating conditions of individual units of a printer must be manually adjusted by a service man according to the use conditions of the installed photosensitive belt whenever a new photosensitive belt is installed in the printer.

SUMMARY OF THE INVENTION

It is therefore, an object of the present invention to provide an improved apparatus and process for replacing photosensitive belts.

It is another object to provide an apparatus for replacing a photosensitive belt in which the information for using a new photosensitive belt properly can be supplied to a controller of a printer without depending on individual performance of a manual adjustment job by a service person. Further objects are to provide a means by which a photosensitive belt can be installed in the printer in an easy manner, and to provide a method of communicating information concerning a new photosensitive belt between a belt cartridge and the printer, and a printer employing the same.

To achieve the above objectives, the invention provides an apparatus for replacing a photosensitive belt including an a belt cartridge adapted to receive a photosensitive belt so that the photosensitive belt can be installed at a belt unit of the printer, a first antenna installed on the belt cartridge, a second antenna installed on the printer and connected to a controller which controls the printer, and a component identifying module installed on the belt cartridge and connected to the first antenna so that the component identifying module can transmit the information recorded therein to the second antenna connected to the controller the, and/or record information received from the controller via the second antenna by wireless.

To achieve the above objectives, there is provided a printer including a belt cartridge for receiving a photosensitive belt therein, a belt unit installed in the main body of the printer to circulate the photosensitive belt, a belt separating means installed at the belt unit to be movable back and forth so that the photosensitive belt can remain installed at the belt unit when the belt cartridge is removed from the main body by applying a tension to the photosensitive belt received in the belt cartridge inserted at an installation position to be installed at the belt unit, a first antenna installed on the belt cartridge, a component identifying module installed on the belt cartridge to be connected to the first antenna so that the information recorded therein can be transmitted, and received information can be recorded, a second antenna provided at the main body in order to communicate with the first antenna by wireless, and a controller installed at the main body to be connected to the second antenna so that the controller can control the reading of the information recorded in the component identifying module and the recording of the information supplied to the component identifying module via the second antenna.

In addition, to achieve the above objectives, the present invention contemplates a process for communicating information with an external device in an apparatus for replacing a photosensitive belt including the steps, performed by the component identifying module, of: (a) deciding whether or not a preset code signal for determining whether to communicate with an external device or not, exists in the information received by the first antenna; (b) performing the communication with the external device when the code signal exists in the received information in step (a); and (c) breaking communication with the external device in order to prevent the information recorded in the component identifying module from leaking when the code signal does not exist in the received information in step (a).

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DESCRIPTION OF THE PREFERRED EMBODIMENTS

Figure 1:
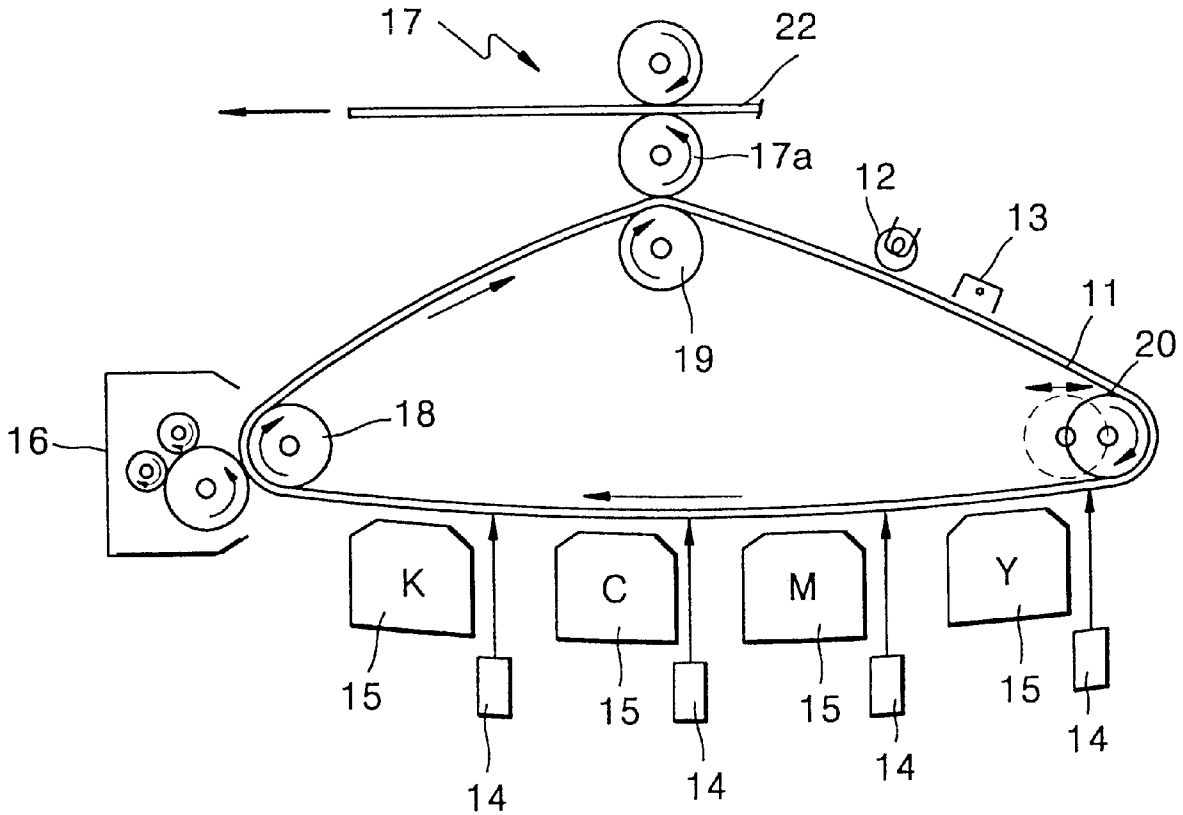
FIG. 1 (PRIOR ART)
FIG. 1 is a diagram illustrating a general printer.

Turning now to the drawings, FIG. 1 illustrates a conventional printer that is equipped with a photosensitive belt 11, a discharging device 12, a charger 13, laser scanning units 14, developing units 15, a drying unit 16, and a transfer unit 17. A belt unit is equipped with a plurality of rollers 18, 19, and 20 disposed to circulate photosensitive belt 11. Reference numeral 18 denotes a drive roller connected to a driving source to circulate photosensitive belt 14, and reference numeral 20 denotes a steering roller installed to be movable.

Discharging device 12 emits light toward circulating photosensitive belt 11 to remove any remaining electrostatic latent image remaining on photosensitive belt 11, and charger 13 charges photosensitive belt 11 to a predetermined potential so that a new electrostatic latent image can be formed on photosensitive belt 11 in a subsequent step. Laser scanning units 14 selectively illuminate charged photosensitive belt 11 to form electrostatic latent images on photosensitive belt 11. Then, the electrostatic latent images are developed with liquid developer supplied from developing units 15. Drying unit 16 dries the image formed with the liquid developer on photosensitive belt 11. The dried image is transferred from photosensitive belt 11 to a paper 22 via a transfer roller 17*a*.

When photosensitive belt 11 is used for a long time, the characteristics of photosensitive belt 11, among the various components involved in such a printing process, deteriorate. Therefore, in order to maintain a desired quality level of prints, photosensitive belt 11 must be replaced periodically. Though a new photosensitive belt 11 can be installed manually around the belt unit, the installation is difficult due to the flexibility of photosensitive belt 11. The conditions of appropriate use of a photosensitive belt may vary by manufacturers and advances in photosensitive belt technology. Such conditions include, for example, a potential level which must be maintained at photosensitive belt 11 so that an electrostatic latent image can be formed on photosensitive belt 11, the intensity of light for illuminating photosensitive belt 11 so that an electrostatic latent image can be formed on photosensitive belt 11, etc. Therefore, it is required that the operation conditions of individual units, for example, discharging device 12, charger 13, laser scanning units 14, and the like be adjusted according to the use conditions of installed photosensitive belt 11 after new photosensitive belt 11 is installed in the printer. We have found however, that these considerations inconveniently suggest that the operating conditions of the individual units of a printer should be manually adjusted by a service technician in order to conform with the conditions of use of installed photosensitive belt 11 after the new photosensitive belt 11 is installed in the printer.

Figure 2:
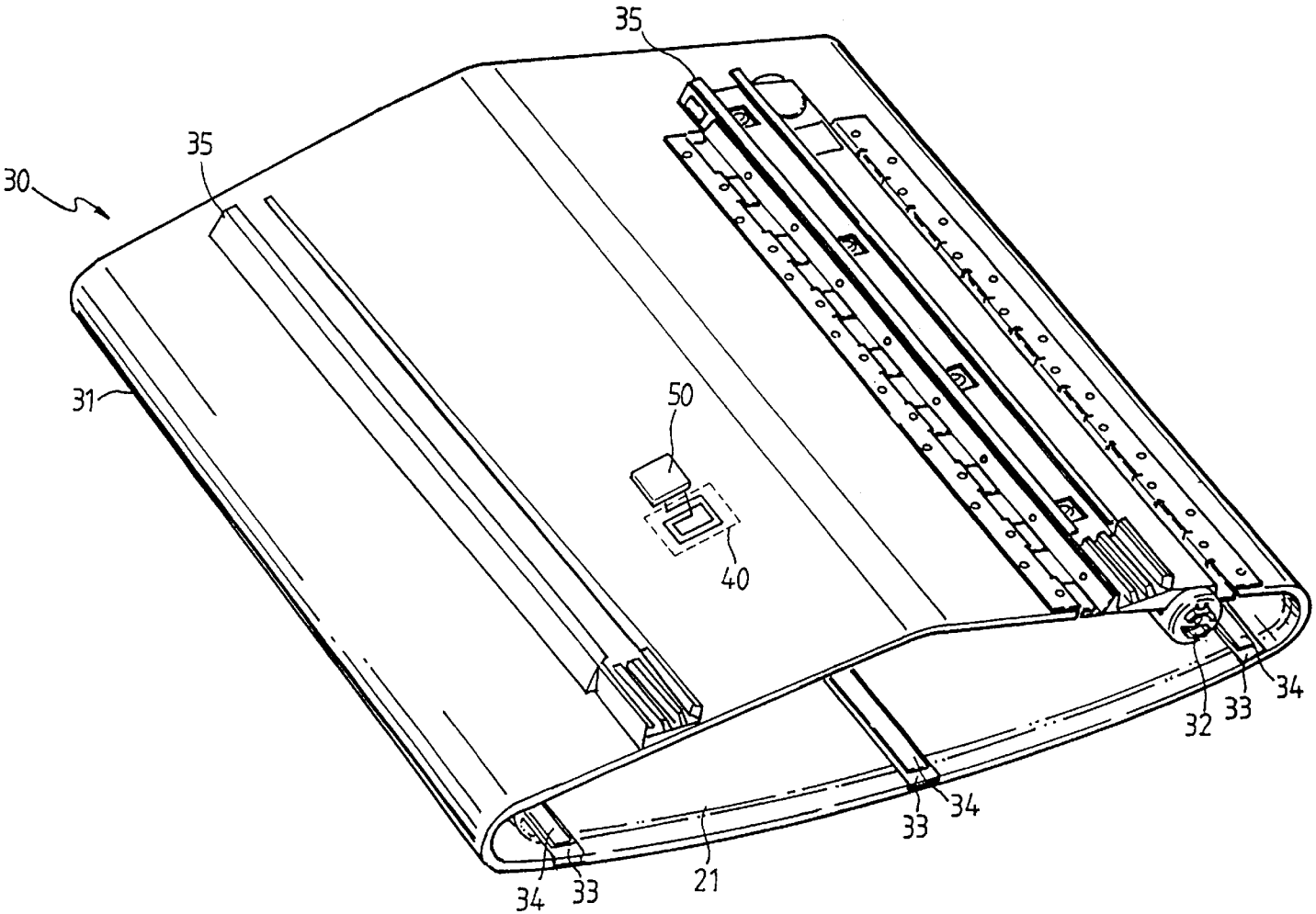
FIG. 2 is a view illustrating an apparatus for replacing a photosensitive belt according to the present invention.
Figure 4:
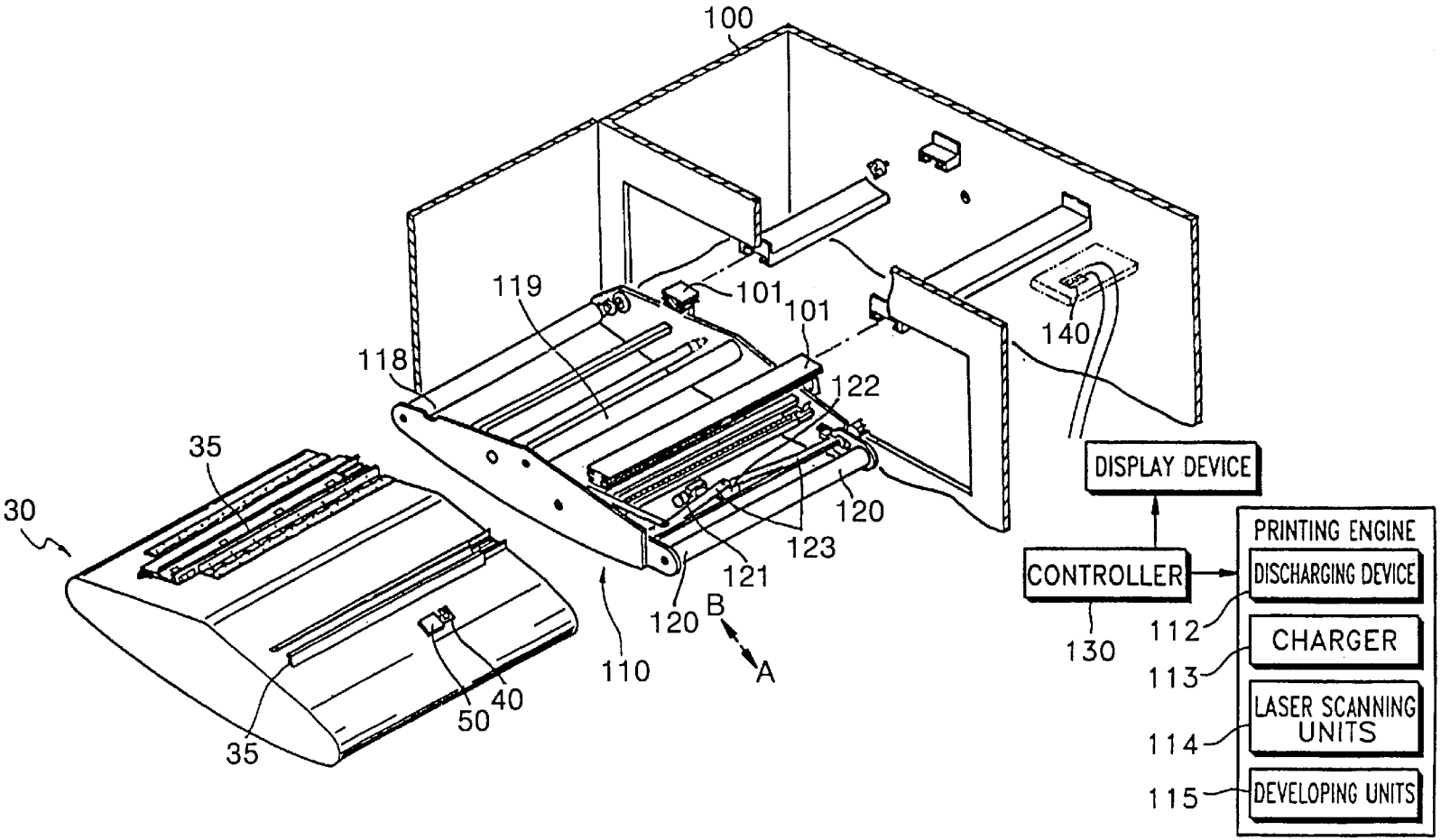
FIG. 4 is an exploded view illustrating a printer to which the apparatus for replacing a photosensitive belt of FIG. 2 is applicable.

FIG. 2 illustrates an apparatus for replacing a photosensitive belt according to the present invention, and FIG. 4 is an exploded view illustrating a portion of a printer to which the apparatus for replacing a photosensitive belt of FIG. 2 is applicable. An apparatus for replacing a photosensitive belt in accordance with the principles of the present invention may be constructed with a belt cartridge 30 for receiving a photosensitive belt 21, a first antenna 40 installed on belt cartridge 30, and a component identifying module 50. Belt cartridge 30 may have a main cartridge 31, and a removable cartridge 32 removably installed in main cartridge 31. Photosensitive belt 21 is received and supported, in the same shape as it is installed in a main body 100 of a printer, between magnetic members 33 and plate members 34 which are intermittently installed to face each other around the inner surface of main cartridge 30.

Figure 3:
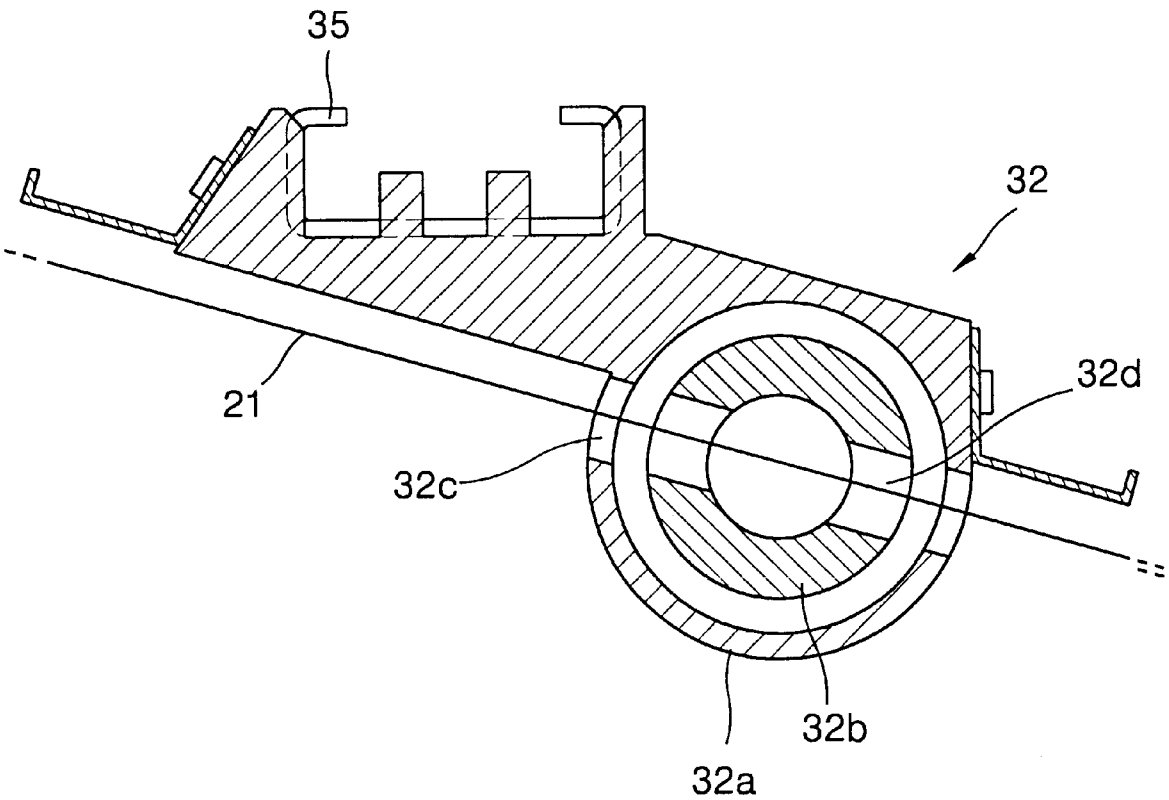
FIG. 3 is a sectional view illustrating the removal cartridge of FIG. 2.

Removable cartridge 32 has a structure making it capable of being installed in the printer together with photosensitive belt 21 when photosensitive belt 21 is installed in a belt unit 110 of the printer. As shown in FIG. 3, removable cartridge 32 comprises a cylinder 32*a* having a hollow cavity, and a revolver 32*b* rotatably installed in cylinder 32*a*. Photosensitive belt 21 can travel without interfering with cylinder 32*a* and revolver 32*b* through first and second slots 32*c* and 32*d* which are formed respectively at cylinder 32*a* and revolver 32*b*. Removable cartridge 32 having such a structure can wind up and receive photosensitive belt 21, which is cut at a point widthwise, in response to the rotation of revolver 32*b*. Therefore, when a photosensitive belt which reaches the end of its usable life is about to be replaced, the photosensitive belt is first cut by a belt cutting means (not shown). Then, after photosensitive belt 21 is wound in removable cartridge 32 by rotating revolver 32*b*, the photosensitive belt can be removed by removing removable cartridge 32 from the printer.

Reference numeral 35 denotes a guide rail, and an insertion rail 101 is provided at main body 100 of the printer for guiding the insertion of guide rail 35 and supporting guide rail 35. A belt unit 110 provided at main body 100 of the printer comprises a drive roller 18 to drive photosensitive belt 21, and a steering roller 120 movably installed at belt unit 110. Steering roller 120 is adjusted back and forth by a sliding mechanism. The sliding mechanism comprises a cam member 122 rotated by a motor 121, and a link member 123 connected to steering roller 120 so that steering roller 120 can be adjusted back and forth according to the rotation of cam member 122.

In the installation of a photosensitive belt 21 of a printer having the above structure, first, after guide rail 35 of belt cartridge 30 is matched with insertion rail 101 of the printer, belt cartridge 30 is inserted into an installation position in the printer. Thereafter, motor 121 is rotated so that steering roller 120 can be moved a predetermined distance in the direction of arrow A. Then, according to the movement of the steering roller, photosensitive belt 21 in belt cartridge 30 is supported by rollers 118, 119, and 120, and the installation steps of photosensitive belt 21 is completed. The operation of separating belt cartridge 30 from main body 100 can be performed after the information exchanging operation between component identifying module 50 which will be described below and a controller 130 of the printer.

First antenna 40 and component identifying module 50 are installed on belt cartridge 30 while connected to each other. A second antenna 140 is installed at main body 100 at a position facing first antenna 40 on belt cartridge 30 when belt cartridge 30 is inserted into the installation position in the printer. Second antenna 140 is electrically connected to controller 130.

Various information required for proper use of photosensitive belt 21 is recorded in component identifying module 50, and component identifying module 50 Is exchanges information with external controller 130 wirelessly via first antenna 40.

Figure 5:
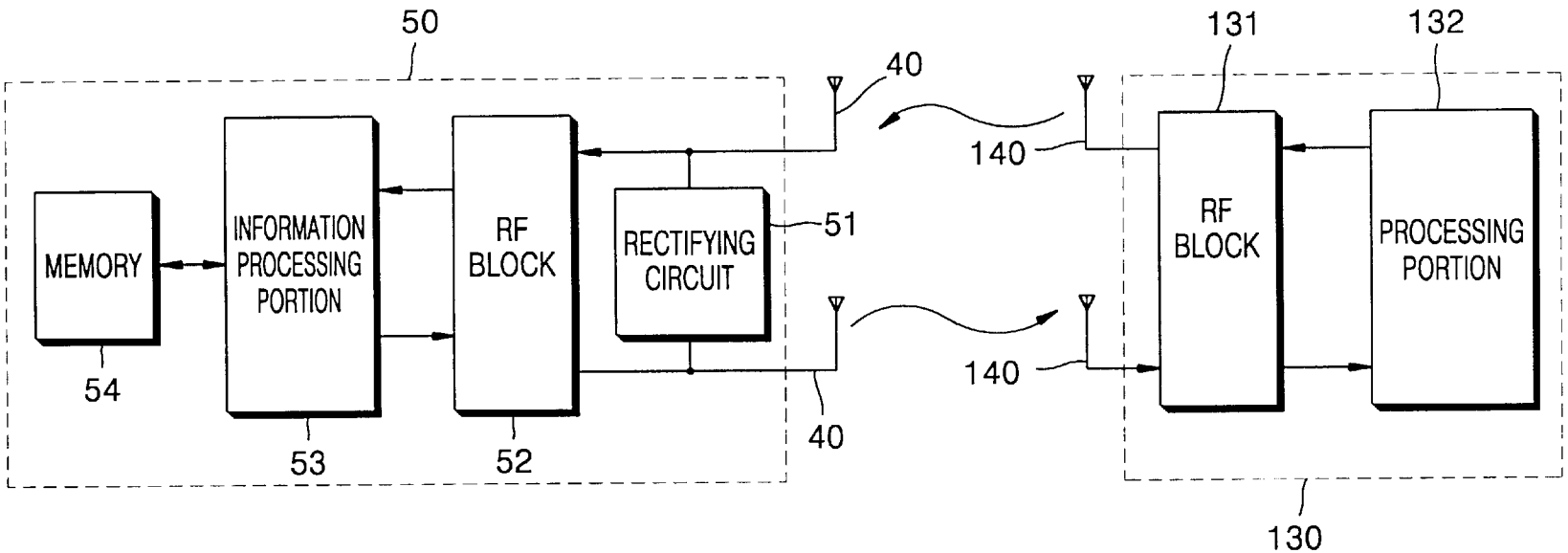
FIG. 5 is a diagram illustrating an example of the configuration of the pair of ago the component identifying module of FIG. 2 and a controller.

As described above, since component identifying module 50 installed on belt cartridge 30 can communicate with controller 130 wirelessly, there is an advantage in that belt cartridge 30 can be inserted into or separated from the printer without considering the electrical connection or disconnection therebetween. An example of the pair of component identifying module 50 and controller 130 will be explained with reference to FIG. 5. Component identifying module 50 comprises a rectifying circuit 51, an RF block 52, an information processing portion 53, and a memory 54. Rectifying circuit 51 is adapted to rectify the electromagnetic wave received by first antenna 40, and to use the rectified current as a driving power.

Figure 6:
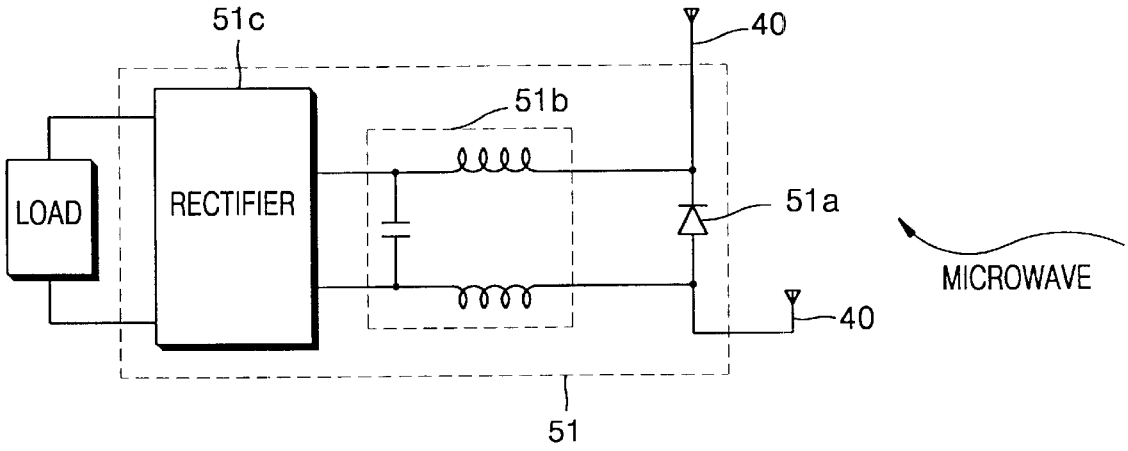
FIG. 6 is a diagram illustrating an example of the configuration of the rectifying circuit of FIG. 5.

Referring now to FIG. 6 showing an example of rectifying circuit 51, the electromagnetic wave received by the first antenna is rectified by a diode 51*a* and a rectifier 51*c*, and rectifying circuit 51 is adapted to store electrical energy. Reference numeral 51*b* denotes a low-pass filter. RF block 52 detects the signal received by first antenna 40, and modulates a carrier wave corresponding to data to be transmitted.

Information processing portion 53 processes the received information.

It is preferable that the memory 54 is a recordable memory that can be recorded to and erased frequently.

It is preferable that information concerning the name, manufacturer, manufactured date, usable life of the component installed in belt cartridge 30 is recorded in memory 54.

In addition, it is preferable that the setting values of a discharging device 112, a charger 113, and laser scanning units 114, which must be applied thereto so that photosensitive belt 21 installed in belt cartridge 30 can be used in optimal condition during the printing operation, are recorded in memory 54. That is, it is preferable that information recorded in memory 54 includes information concerning the intensity of light emitted from discharging device 112 in order to remove an electrostatic latent image, the value of a charging potential applied to photosensitive belt 21 by charger 113 so that a new electrostatic latent image can be formed in a subsequent step, and the intensity of light emitted from laser scanning units 114 so that an electrostatic latent image can be formed on charged photosensitive belt 21, when photosensitive belt 21 is installed around belt unit 110. Reference numeral 115 denotes developing units.

Controller 130 controls the overall system of the printer. Controller 130 includes an RF block 131 for communicating with component identifying module 50, and a processing portion 132.

RF block 131 of controller 130 performs the modulation of a carrier wave corresponding to the data transmitted from processing portion 132, the transmission of the modulated signal, and the demodulation of the signal received from the second antenna 140.

Figure 7:
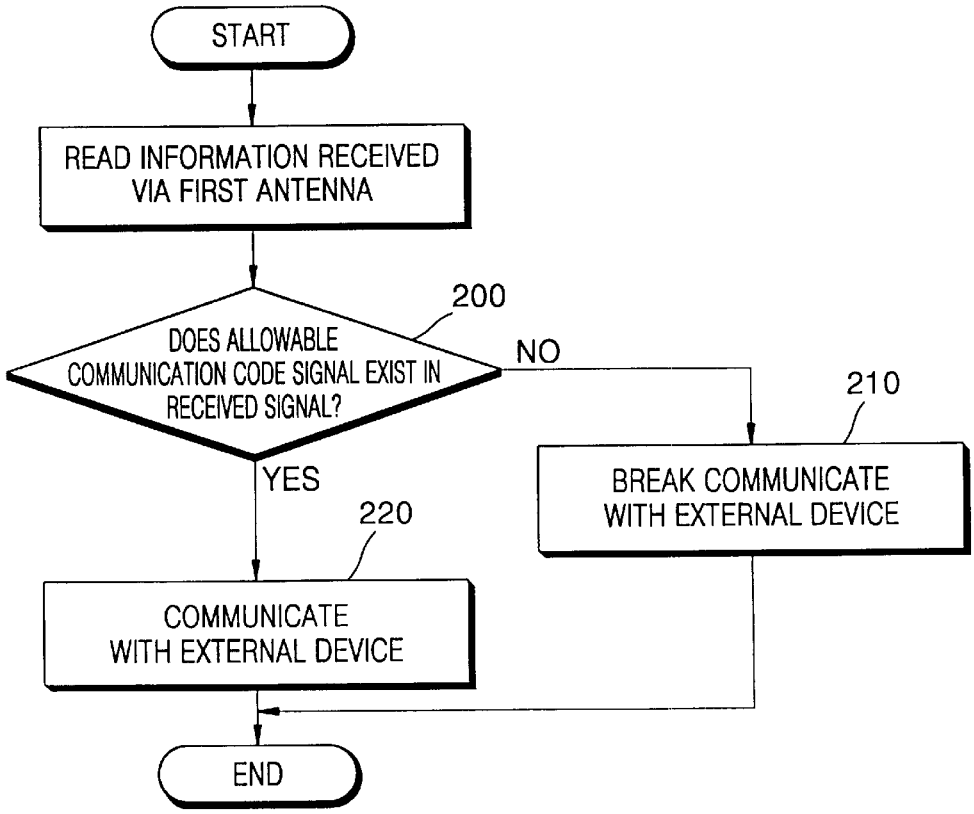
FIG. 7 is a flow chart illustrating the communicating steps of a component identifying module according to the present invention with an external device.

The steps of exchanging information between component identifying module 50 and controller 130 will be described with reference to FIG. 7.

First, when belt cartridge 30 is installed in the printer, controller 130 causes a preset allowable communication code signal and the content in question to be transmitted via second antenna 140. At this time, RF block 131 of controller 130 performs modulation by combining the RF signal corresponding to data transmitted from the processing portion 132 and a preset low frequency signal, and transmits the modulated signal via second antenna 140.

The low frequency signal of the signal received by first antenna 40 is rectified by rectifying circuit 51 of component identifying module 50, and is used as a driving power for component identifying module 50. RF block 52 of component identifying module 50 demodulates the received and detected RF signal, and outputs the demodulated signal to information processing portion 53. Information processing portion 53 reads the received signal, and decides whether or not there is a preset allowable communication code signal in the received signal (step 200). When, in step 200, it is decided that there is not a preset allowable communication code signal, component identifying module 50 breaks communication with the external device (step 210). To the contrary, when, in step 200, it is decided that there is the preset allowable communication code signal, component identifying module 50 continues to communicate with the external device (step 220). To make component identifying module 50 communicate with the external device only when the allowable communication code signal is received is intended to prevent malicious copying of information recorded in component identifying module 50. When the communication between component identifying module 50 and controller 130 begins, and a read signal requiring transmission of the recorded information concerning the name of the component and the use of the component is received, component identifying module act 50 transmits the recorded information corresponding to the received requirements. Therefore, the information recorded in memory 54 of component identifying module 50, that is, information that the component is a photosensitive belt, the manufacturer and manufactured date of the photosensitive belt, the usable life of the photosensitive belt, information concerning the intensity of light for illuminating the photosensitive belt in order to remove an electrostatic latent image, the value of a charging potential applied to the photosensitive belt so that a new electrostatic latent image can be formed in the subsequent step, and the intensity of light is emitted from laser scanning units 114 so that an electrostatic latent image can be formed on the charged photosensitive belt is transmitted to controller 130.

Then, controller 130 sets driving voltages or currents of discharging device 112, charger 113, and laser scanning units 114 according to the characteristic information of the component transmitted from component identifying module 50. When the setting operation of the relevant devices is completed to meet the requirements of the newly installed photosensitive belt, a printing operation can be performed.

As described above, with the apparatus for replacing a photosensitive belt, the method of communicating information concerning a new photosensitive belt, and the printer employing the same according to the present invention, the setting operation of the printer, which is due to replacement of a component, can be simplified since the characteristic information of the component is supplied to the controller during the replacement of the component so that the controller of the printer can read the information. In addition, since the component identifying module is designed to not communicate with an external device which does not transmit a preset allowable communication signal, unwanted access to the information recorded in the component identifying module can be restricted.

What is claimed is:

1. A printer apparatus, comprising:

a belt cartridge adapted for receiving a replaceable photosensitive belt, said belt cartridge comprising:

a main cartridge;

a removable cartridge removably installed in the main cartridge;

a first antenna;

a component-identifying module electronically coupled to the first antenna and adapted to transmit to the first antenna and receive therefrom information concerning the photosensitive belt and operational parameters thereof or concerning the printer apparatus, said information such as to facilitate automatic installation of a new belt and making it operational without manual adjustment by service personnel, said component-identifying module comprising a memory for recording a plurality of data items adapted for facilitating automatic installation of a new belt and making it operational without manual adjustment by service personnel, said plurality of data items selected from a data set comprising:

a first data item including the name, name of manufacturer, manufacture data, and usable life of a component installed in the belt cartridge;

a second data item representative of an intensity of light for illuminating the photosensitive belt in order to remove an electrostatic latent image;

a third data item representative of a value of an electric potential to be applied to the photosensitive belt; and a fourth data item representative of an intensity of light to be emitted from laser scanning units of the printer apparatus;

a belt unit adapted to removably engage with the belt cartridge and adapted to circulate the photosensitive belt, said belt unit comprising a belt separating means for reciprocating within the belt unit to permit the photosensitive belt to remain installed at the belt unit when the belt cartridge is removed from the printer apparatus;

a second antenna adapted to communicate with the first antenna; and a controller electronically coupled to the second antenna to permit the controller to control communication of information between the first antenna and the second antenna.

2. The printer apparatus of claim 1, wherein the belt separating means comprises means for applying a tension to the photosensitive belt when the belt is received in the belt cartridge and is inserted at an installation position for installation at the belt unit.

3. The printer apparatus of claim 1, wherein the belt separating means comprises:

a steering roller installed at the belt unit, said steering roller rotatable and movable for supporting the circulating photosensitive belt; and an adjustment means for adjusting a movement of the steering roller to apply a tension to the photosensitive belt.

4. The printer apparatus of claim 3, wherein said adjustment means comprises:

a motor adapted for driving a cam;

a cam member rotated by said motor; and a link member connected to the steering roller to adjust the location of the steering roller according to the rotation of the cam member.

5. The printer apparatus of claim 1, wherein the component-identifying module comprises a rectifying circuit adapted to rectify an electromagnetic wave received via the first antenna and produce therefrom a rectified current, and adapted to use the rectified current as driving power for the component-identifying module.

6. An apparatus for replacing a photosensitive belt for a printer, said printer comprising a printer-based antenna electronically coupled to a controller adapted to control transmittal and reception of information by the printer-based antenna, said printer further comprising a belt unit adapted to engage and disengage with a belt cartridge, said apparatus comprising:

a belt cartridge adapted to receive the photosensitive belt for the printer, so that the photosensitive belt can be installed at the belt unit of the printer, said belt cartridge removably insertable into the belt unit of the printer;

a cartridge-based antenna installed on the belt cartridge and adapted to communicate with the printer-based antenna; and a component-identifying module installed on the belt cartridge and electronically coupled to the cartridge-based antenna, said component-identifying module adapted to transmit and receive information concerning the photosensitive belt and operational parameters thereof or concerning the printer, said information such as to facilitate automatic installation of a new belt and making it operational without manual adjustment by service personnel, said component-identifying module comprising a memory for recording a plurality of data items adapted for facilitating automatic installation of a new belt and making it operational without manual adjustment by service personnel, said plurality of data items selected from a data set comprising:

a first data item including the name, name of manufacturer, manufacture data, and usable life of a component installed in the belt cartridge;

a second data item representative of an intensity of light for illuminating the photosensitive belt in order to remove an electrostatic latent image;

a third data item representative of a value of an electric potential to be applied to the photosensitive belt; and a fourth data item representative of an intensity of light to be emitted from laser scanning units of the printer apparatus.

7. The apparatus of claim 6, wherein the component-identifying module comprises a rectifying circuit adapted to rectify an electromagnetic wave received via the cartridge-based antenna and produce therefrom a rectified current, and adapted to use the rectified current as driving power for the module.

8. A method of communicating information in an apparatus for replacing a photosensitive belt for a printer, said method adapted for automatically installing a new belt and making it operational without manual adjustment by service personnel, said printer comprising:

a belt cartridge adapted to receive a photosensitive belt so that the photosensitive belt can be installed at the belt of the printer;

a first antenna installed on the belt cartridge; a second antenna installed the printer; and a component-identifying module installed on the belt cartridge and adapted to be electronically coupled to the first antenna to transmit and receive information between the component-identifying module and a controller which controls the printer via the second antenna, said information such as to facilitate automatic installation of a new belt and making it operational without manual adjustment by service personnel, the method comprising steps, performed by the component-identifying module, for:

(a) deciding whether or not a preset code signal for determining whether to communicate with an external device, exists in the information received by the first antenna;

(b) performing communication with the external device when the code signal exists in the received information in step (a); and (c) breaking communication with the external device to prevent the information recorded in the component identifying module from being leaked when the code signal does not exist in the received information in step (a).

9. A method for replacing a photosensitive belt of an image-forming apparatus without depending on individual performance of a manual adjustment job by service personnel, said photosensitive belt and said image-forming apparatus requiring, upon a belt-replacement, adjustment in accordance with information concerning a plurality of operating parameters, said method comprising steps for:

(1) recording information concerning values of a plurality of operating parameters for the image-forming apparatus or the photosensitive belt, in a rewritable electronic memory, said information such as to facilitate automatic installation of a new belt and making it operational without manual adjustment by service personnel;

(2) removing from the image-forming apparatus a photosensitive belt in need of replacement;

(3) installing in the image-forming apparatus a replacement photosensitive belt;

(4) communicating the recorded information concerning values of a plurality of operating parameters for the image-forming apparatus or the photosensitive belt from the rewritable electronic memory to an electronic controller means adapted for automatically adjusting operating parameters for the image-forming apparatus or the photosensitive belt;

(5) causing the electronic controller means automatically to adjust operating parameters for the image-forming apparatus or the photosensitive belt in accordance with the recorded information communicated from the rewritable electronic memory to the electronic controller means.

10. The method of claim 9, wherein said operating parameters recorded in the rewritable memory include a plurality of data items adapted for facilitating automatic installation of a new belt and making it operational without manual adjustment by service personnel, said plurality of data items selected from a data set comprising:

a first data item including the name, name of manufacturer, manufacture data, and usable life of the component installed in the belt cartridge;

a second data item representative of an intensity of light for illuminating the photosensitive belt in order to remove an electrostatic latent image;

a third data item representative of a value of an electric potential to be applied to the photosensitive belt; and a fourth data item representative of an intensity of light to be emitted from laser scanning units of the printer.

* * * * *